US005777343A

United States Patent [19]

Rasel et al.

[11] Patent Number: 5,777,343

[45] Date of Patent: Jul. 7, 1998

[54] URANIUM HEXAFLUORIDE CARRIER

[75] Inventors: Gerald E. Rasel, Columbiana; Alan Eckert; Trevor M. Rummel, both of Leetonia, all of Ohio

[73] Assignee: The Columbiana Boiler Company, Columbiana, Ohio

[21] Appl. No.: 646,977

[22] Filed: May 8, 1996

[51] Int. Cl.[6] ..... G21F 5/12

[52] U.S. Cl. ..... 250/506.1; 220/679

[58] Field of Search ..... 250/506.1; 220/679

[56] References Cited

U.S. PATENT DOCUMENTS

| | | | |
|---|---|---|---|
| 4,567,014 | 1/1986 | Popp et al. | 376/272 |
| 4,572,959 | 2/1986 | Popp et al. | 250/506.1 |
| 4,738,388 | 4/1988 | Bienek et al. | 228/135 |
| 4,810,890 | 3/1989 | Blum | 250/506.1 |
| 4,818,878 | 4/1989 | Popp et al. | 250/507.1 |
| 5,064,575 | 11/1991 | Madle et al. | 252/633 |
| 5,211,327 | 5/1993 | Clarke et al. | 228/174 |
| 5,346,096 | 9/1994 | Diersch et al. | 250/506.1 |
| 5,391,887 | 2/1995 | Murray, Jr. | 250/506.1 |
| 5,442,186 | 8/1995 | Walker et al. | 250/506.1 |

OTHER PUBLICATIONS

ANSI Publication N14.1–1990, Uranium Hexafluoride—Packaging for Transport, approved Jun. 21, 1990, American National Standards Institute, Inc.

ANSI Publication N14.–1971, Packaging of Uranium Hexafluoride for Transport, approved Oct. 6, 1971, American National Standards Institute, Inc.

U.S. Department of Commerce Publication ORO 651, Uranium Hexafluoride Handling Procedures & Container Criteria, E.L. Keller, Union Carbide Corporation, 1966.

United States Atomic Energy Commission Publication No. ORO–651 (Revision 3), Uranium Hexafluoride: Handling Procedures and Container Criteria, Aug. 1972.

*Primary Examiner*—Jack I. Berman

*Attorney, Agent, or Firm*—Renner, Otto, Boisselle & Sklar, P.L.L.

[57] ABSTRACT

A container complying with ANSI® N14.1 for containing uranium hexafluoride ($UF_6$) which minimizes entrapment of contaminants, thereby increasing the decontaminability of the container. The container includes a cylindrical shell welded to two cylinder heads wherein the weld inside the container provides a smooth transition between the heads and the shell while complying with ANSI® N14.1. The heads and the shell each have an annular land. A plasma weld fully penetrates the opposing lands to join the heads and the shell. No backup bar is used during the welding process.

7 Claims, 4 Drawing Sheets

URANIUM HEXAFLUORIDE CARRIER

FIELD OF THE INVENTION

This invention relates generally to a transportation container manufactured in compliance with national standards for low-level nuclear or other hazardous materials and, more particularly, to a transportation container meeting ANSI® N14.1 for transporting uranium hexafluoride.

BACKGROUND OF THE INVENTION

Nuclear, biological and chemical hazardous materials are often mined, enriched or created at a given location and then transported to another site for processing. Containers for transporting low-level nuclear materials, such as uranium hexafluoride ($UF_6$), have been in use since the 1950s. Safety concerns, however, require that the construction of these containers meet certain national standards.

The current construction standard for transporting uranium hexafluoride is set by the American National Standards Institute, Inc. (hereinafter ANSI®) in ANSI N14.1. ANSI® N14.1 requires containers to be fabricated in accordance with Section VIII, Division 1 of the ANSI/ASME Code. (ASME is the American Society of Mechanical Engineers). Although many changes have been made to ANSI® N14.1 and its predecessors over the years, the essential requirements have remained substantially the same. The U.S. Department of Energy (hereinafter DOE) provided the initial guidelines for transporting uranium hexafluoride, beginning with K-1323, *A Brief Guide to $UF_6$ Handling*, in 1957, and ORO-651 from 1966 through 1991. In 1993 the United States Enrichment Corporation (hereinafter USEC) assumed responsibility for publishing the uranium hexafluoride guidelines, including USEC-651, *Uranium Hexafluoride: A Manual of Good Handling Practices*, published in 1995. The ANSI® standards have been published since 1971 and have been updated periodically, with the most recent addition published in 1990. All containers in use today are built in accordance with ANSI® N14.1, which specifies design conditions, fabrication standards, testing methods and requirements, material requirements, initial cleaning requirements and certification requirements.

There are three main types of containers, referred to as 48X, 48Y and 30B. The 30B container is the principal container used to carry enriched uranium hexafluoride. It is further characterized by the fact that it is approximately 30 inches in diameter and can carry two and a half tons of $UF_6$. The 48X and 48Y containers are characterized by the fact that they are 48 inches in diameter and require the addition of stiffening rings. The 48X and 48Y containers are generally used only to carry unenriched uranium hexafluoride. For purposes of the following description, a 48Y container is illustrated and described, however, it will be understood the invention is applicable to any of the three types of containers.

All of the prior art containers for uranium hexafluoride have been fabricated by welding a pair of formed heads to a cylindrical shell. FIG. 1 illustrates a head-to-shell joint in a prior art container. In FIG. 1, the head 10 and shell 15 come together at weld joint edges 20 and 25, respectively. These edges 20 and 25 are usually beveled at an angle to improve the weldability of the joint. When the container is closed by placing the second head 10 onto the shell 15, the welding can only be done from outside the container. In order to ensure a full penetration weld which is required by ANSI® N14.1, a backing bar 30 has been used behind the joint. In fact, the backing bar has been shown and described in ANSI® N14.1 and all its predecessors.

A small shell-to-backing bar weld 32 holds the backing bar 30 in place against the shell 15 until the shell can be welded to the head 10. When the shell-to-backing bar weld 32 is deposited, the inside corner 34 of the backing bar usually is lifted slightly from the surface of the shell due to welding stresses. This creates a small crevice 46 (FIG. 2) under the backing bar. The backing bar 30 has been formed with a chamfered edge 33 (FIGS. 1 and 2) radially outward on the head side of the backing bar 30 to make it easier to fit the head 10 up to the shell 15. The head 10 has been fitted up to the shell 15 with a small gap 35 remaining between the weld joint edges 20 and 25 on the head 10 and the shell 15, respectively.

ANSI® N14.1 mandates that all pressure part welds be full penetration. As illustrated in FIG. 2, the use of the backing bar 30 allows a full penetration butt weld 40. The butt weld 40 partially extends into the backing bar 30 in order to guarantee complete fusion between the head 10 and the shell 15. However, the pulling away of the backing bar 30 from the shell 15 combined with the chamfer 33 on the backing bar 30 create crevices 45 and 46, respectively, between the backing bar 30 and the head 10, and between the backing bar and the shell as shown in FIG. 2. Containers made this way have been adequate structurally, but are difficult or impossible to clean at least in part because material collects in the crevices 45 and 46.

Uranium hexafluoride containers are generally loaded with liquid uranium hexafluoride. The material becomes a solid at the ambient temperatures during transport, and the uranium hexafluoride is heated back to the liquid phase for removal from the container. The prior art containers cannot be cleaned sufficiently to remove all of a prior shipment so as to allow their use with different assay grades of uranium hexafluoride. For example, once a container has been used for one assay grade of uranium hexafluoride, it has not thereafter been used to transport a different assay grade of uranium hexafluoride because of the contamination caused by the entrapped materials.

ANSI® requires periodic hydrostatic testing of the containers to ensure their continued safety. Accumulated material left in the crevices behind the backing bar contaminates the water used in the pressure test. This contaminated water is considered a hazardous waste requiring expensive disposal. Thus a container which retains less contaminants could be used more flexibly and would generate less hazardous waste as a result of the required hydrostatic testing.

SUMMARY OF THE INVENTION

The present invention provides a novel container complying with ANSI® N14.1 for transporting uranium hexafluoride ($UF_6$) which minimizes entrapment of contaminants, thereby increasing the decontaminability of the container. The present invention also provides a novel method for making this container.

The container and method are characterized by a cylindrical shell welded to a pair of cylinder heads wherein the weld inside the container provides a smooth transition from the heads to the shell while complying with ANSI® N14.1. The shell and the heads each have annular lands which are welded together with a carefully controlled full penetration weld, such as a plasma arc weld which requires no backing bar.

In accordance with another aspect of the invention, the shell and the heads also have beveled weld faces radially outward of the land. These beveled weld faces combine to form V-shaped grooves. The V-shaped grooves are filled with a second weld which completes the full penetration welded joint. In a preferred embodiment, a plasma weld joins the heads and the shell at their lands, and a submerged arc weld completes the joint in the V-shaped grooves.

In accordance with another aspect of the invention, the V-shaped grooves form an included angle from about 45 degrees to about 135 degrees. In a preferred embodiment the included angle of the V-shaped grooves is about 90 degrees.

According to another aspect of the invention, a substantially similar container may be used for other types of hazardous materials.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
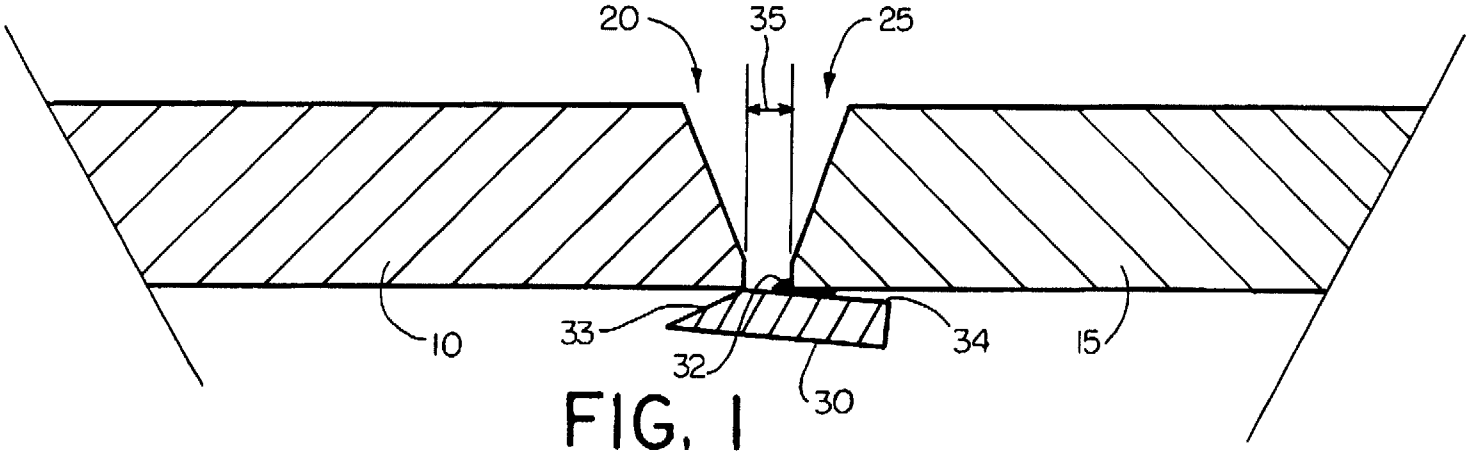
FIG. 1 PRIOR ART
FIG. 1 is a schematic sectional view of a weld joint in a prior art container before welding.
Figure 2:
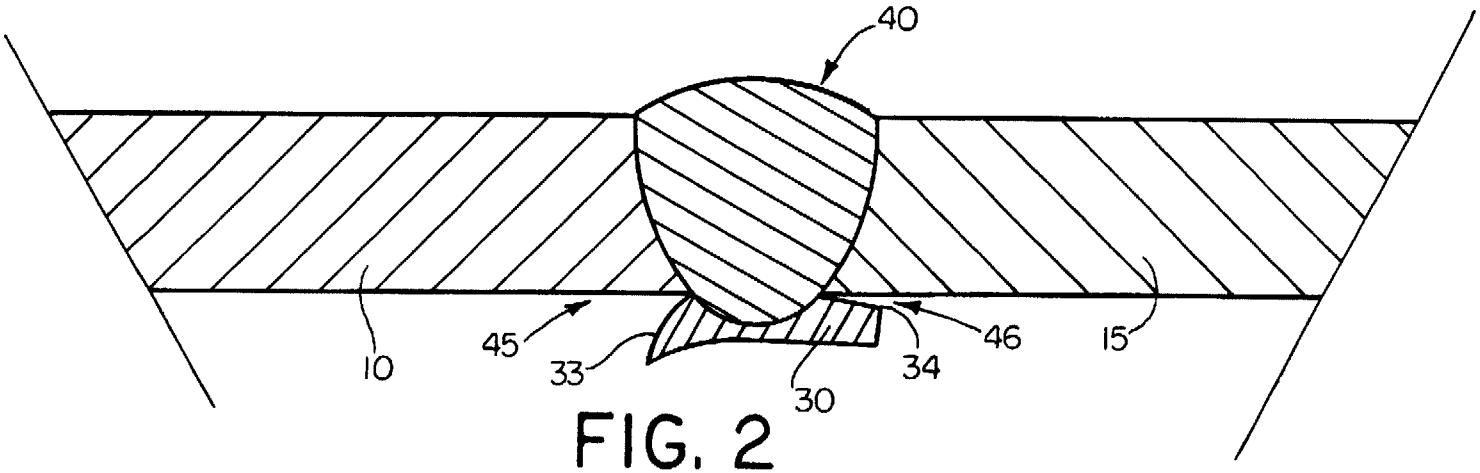
FIG. 2 PRIOR ART
FIG. 2 is a schematic sectional view of a weld joint in a prior art container after welding.
Figure 3:
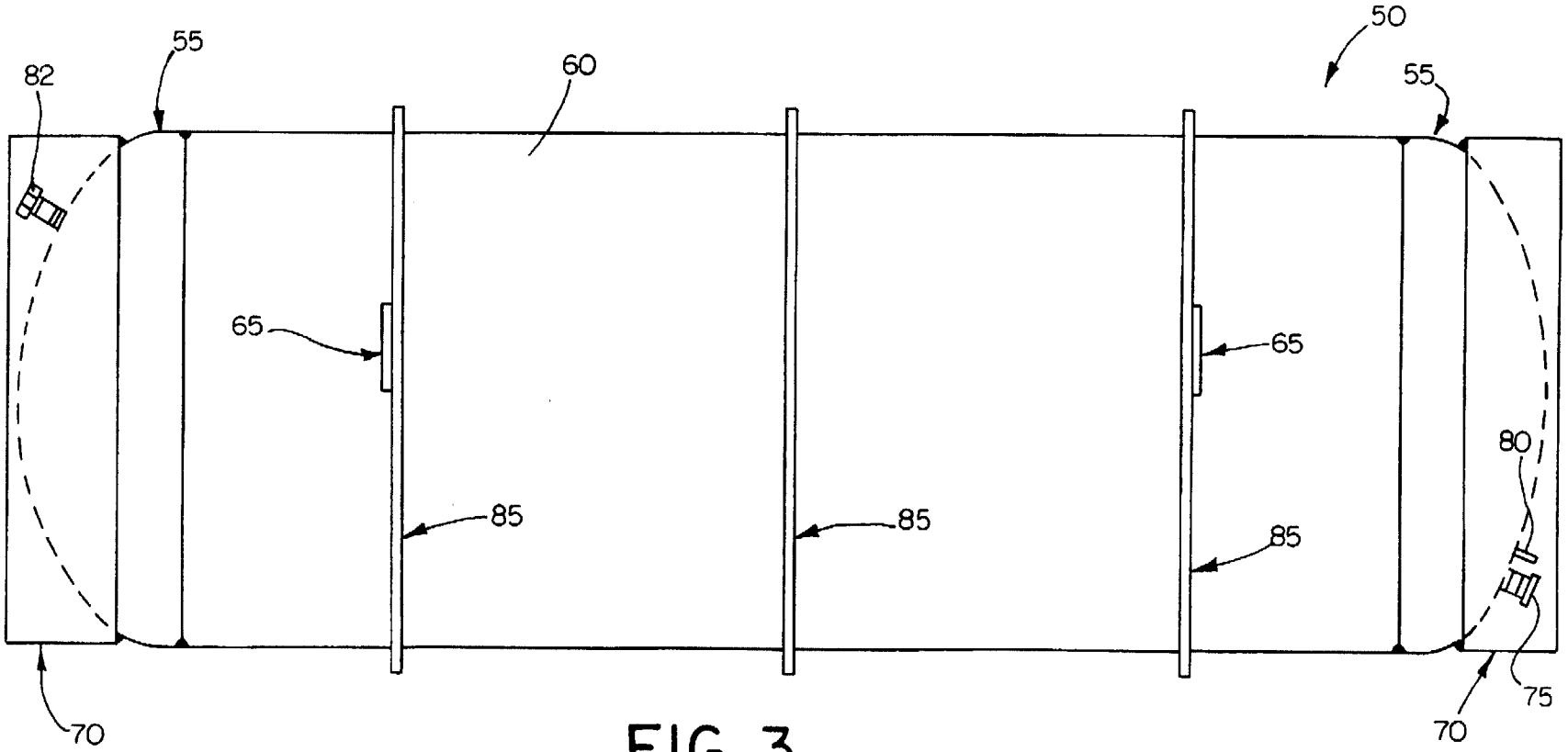
FIG. 3 is a side elevation view of a container according to the present invention and assembled from a cylindrical shell and a pair of cylinder heads.
Figure 4:
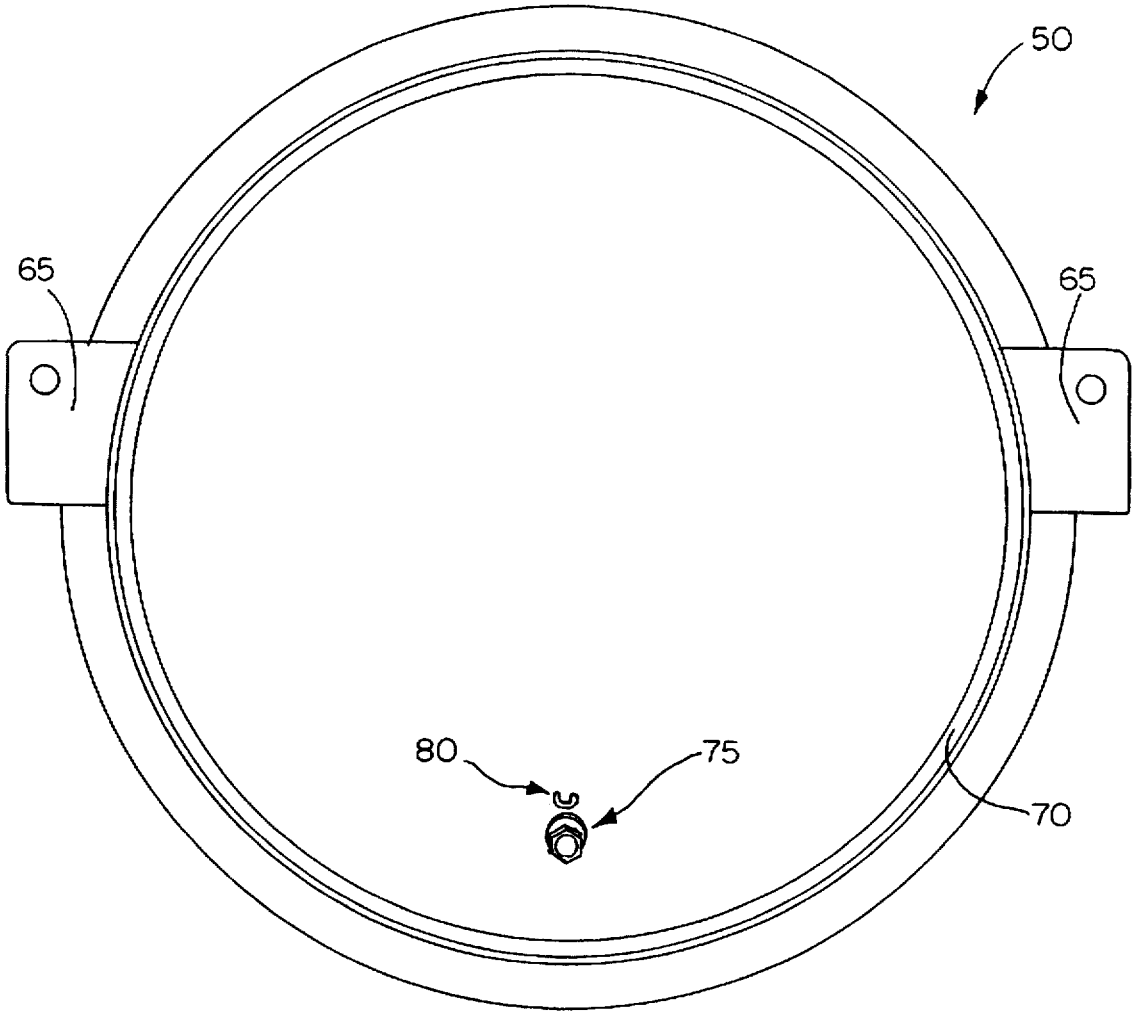
FIG. 4 is an end elevation view of a container according to the present invention.

Referring now in detail to the drawings and initially to FIGS. 3 and 4 there is illustrated an exemplary embodiment of a container 50 complying with ANSI® N14.1 for transporting uranium hexafluoride ($UF_6$). The container 50 includes a pair of formed cylinder heads 55 one welded to each end of a cylindrical shell 60. When requiced by ANSI® N14.1, the container 50 includes four lifting lugs 65 attached to the shell 60 and a cylindrical skirt 70 attached to each head 55. As seen in FIG. 4 the skirt 70 functions to protect a plug 75 and a coupling 80 in the head 55. On the opposing head 55, the skirt 70 protects a valve 82 in the head 55. The shell 60 may also include a plurality of stiffening rings 85 which further protect the shell 60 and increase the stiffness of the container 50.

The materials for the cylinder shell, heads and skirts must be selected to conform to ASTM A516, Grade 55, 60, 65 or 70 steel and are normalized as required by ANSI® N14.1. For example, for a 48Y container, the shell, heads, lifting lugs, stiffening rings and skirts are generally fabricated from ASTM SA516 Grade 60 Normalized material that meets SA-20 supplement SA-5. When stiffening rings are required, then the shell steel is also made by a low sulfur practice with inclusion shape control, with sulfur content not greater than 0.010%, as is conventional in ANSI® N14.1 containers.

Figure 5:
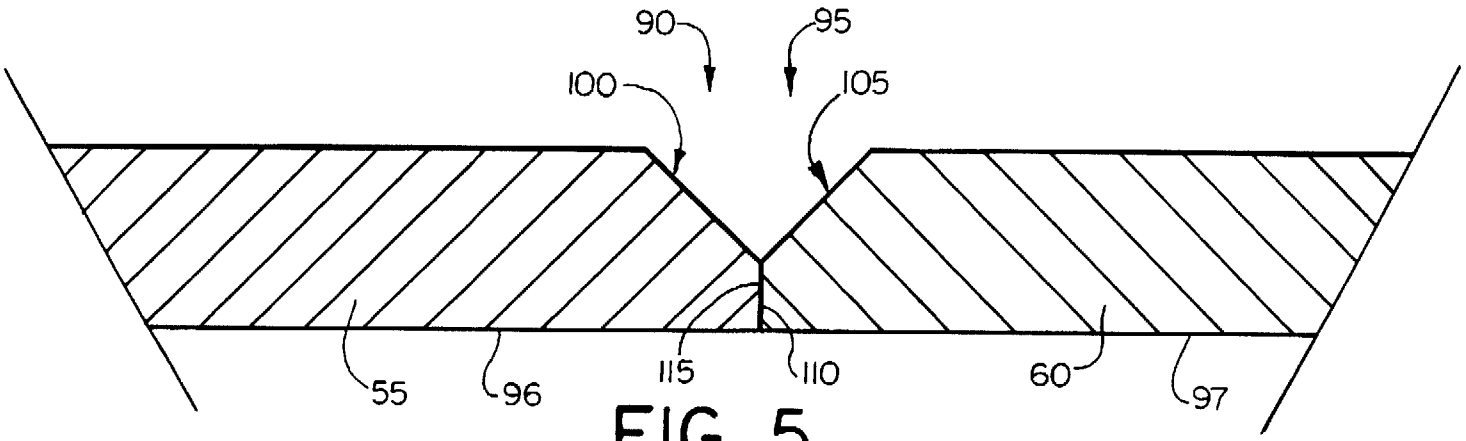
FIG. 5 is a schematic sectional view of a joint between the shell and a cylindrical head of FIG. 3 before welding.
Figure 6:
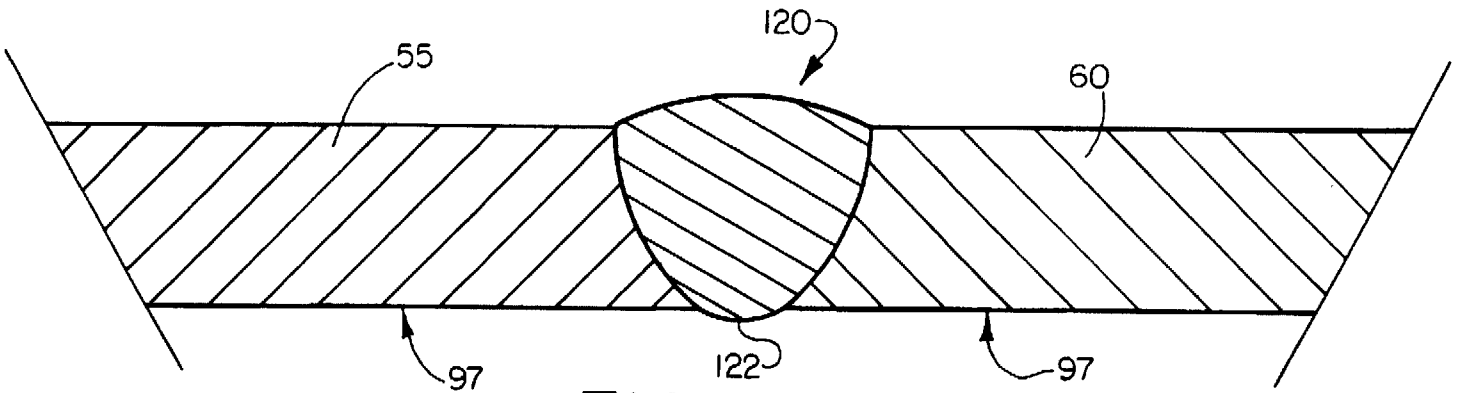
FIG. 6 is a schematic sectional view of the joint of FIG. 5 after welding.

As illustrated in FIGS. 5 and 6, the improvement provided by the invention lies in the welded joint between the head 55 and the shell 60 and the container which results. The head 55 and shell 60 have end faces 90 and 95, respectively, which are shaped to facilitate welding of the head to the shell. For this reason, each end face 90 and 95 includes an beveled weld face 100 and 105, respectively. The beveled weld faces 100 and 105 create a V-shaped included angle of between 45 and 135 degrees, with a preferred included angle of about 90 degrees which opens radially outwardly.

Each end face 90 and 95 also includes an annular land 110 and 115 on the radially inner side 96 of the head 55 and the radially inner side 97 of the shell 60, respectively. The head 55 is fitted to the shell 60 so that the lands 110 and 115 butt together on a plane that is normal to the longitudinal axis of the container 50 in preparation for welding the joint. This meets the requirements of ANSI® N14.1 without the need for a backing bar and the additional welding step formerly required to attach the backing bar. For instance, if the wall thickness of the head 55 and shell 60 is one half inch and has a land of three-sixteenths of an inch, then the bulk of the thickness is made up by the bevel.

The welding procedures comply with Section IX of the ANSI/ASME Code as required by ANSI® N14.1. Preferably a plasma weld joins the head 55 and the shell 60 at their lands 110 and 115, and a submerged arc weld radially outward of the plasma weld fills the V-shaped groove and completes the butt weld seam. Other types of welds may be used to join the head and the shell, such as TIG, consumable insert, electron beam process, MIG, or flux core welds.

The particular welding process selected influences the radial extent of the lands 110 and 115. The lands 110 and 115 have a radial extent that permits a full penetration weld with the selected welding process with such control that the interior surface 122 of the weld 120 remains substantially smooth and even with the interior surfaces 96 and 97 of the head 55 and shell 60 as illustrated in FIG. 6. Thus the lands 110 and 115 may vary from a knife edge to the full plate thickness, depending on the type of weld to be used. With a plasma arc weld, the lands 110 and 115 may be from about one-sixteenth inch thick to about five-sixteenths inch thick. With an electron beam welding process, similar results could be obtained even if the lands 110 and 115 extended the entire thickness of the shell head 55 and shell 60.

The included angle between faces 100 and 105 is selected for convenience. If the included angle is substantially less than about 40°, it is difficult to get to the bottom of the groove to weld the lands 110 and 115. At the other extreme, a weld angle of more than 140° results in the need to apply more filler material than is economical. The preferred included angle of about 90° represents a compromise between accessibility and the required volume of filler material.

As seen in FIG. 6, the resulting full depth weld 120 complies with the ANSI® N14.1 requirements and provides a smooth transition from the inner surface 96 of the head 55 across the well bead 122 to the inner surface 97 of the shell 60. The smooth transition inhibits the entrapment of material inside the container 50, thereby allowing the container 50 to be cleaned and used with different assay grades of uranium hexafluoride.

One may now appreciate that the present invention provides a container for transporting uranium hexafluoride that complies with ANSI® N14.1 and eliminates the need for a backing bar. Although the invention has been shown and described with respect to a certain preferred embodiment, it is obvious that equivalent alterations and modifications will occur to others skilled in the art upon reading and understanding this specification. The present invention includes all such equivalent alterations and modifications both to the materials used in the invention and to the standards required for uranium hexafluoride containers.

What is claimed is:

1. A container complying with ANSI® N14.1 for containing uranium hexafluoride ($UF_6$) which minimizes entrapment of contaminants thereby increasing the decontaminability of the container comprising:

a cylindrical shell;

two cylinder heads, each head closing one end of the shell;

the shell and at least one of the heads each having an annular land with an inner diameter, the inner diameter of the land of the shell being substantially the same as the inner diameter of the land of the one of the heads and the lands of the shell and head being positioned to abut each other so as to provide a smooth transition in the interior of the container from the shell to the one of the heads;

the shell and the one of the heads being joined together by a weld fully penetrating the opposing lands, the weld being formed by a plasma arc welding process;

the shell and the one of the heads also having beveled weld faces radially outward of the respective lands, the beveled weld faces on the shell and the one of the heads cooperating to define a generally V-shaped groove and a submerged arc weld radially outward of the plasma weld and substantially filling the remainder of the V-shaped groove, and wherein each land has an outer diameter, the outer diameter of the land of the shell and the outer diameter of the land of the one of the heads being substantially the same, thereby cooperating to form a point at the base of the V-shaped groove.

2. A container complying with ANSI® N14.1 as set forth in claim 1, wherein the lands on the shell and the heads are substantially parallel.

3. A container complying with ANSI® N14.1 as set forth in claim 1, wherein the V-shaped groove forms an angle from 40 degrees to 135 degrees.

4. A container complying with ANSI® N14.1 as set forth in claim 1, wherein the V-shaped groove forms an angle of about 90 degrees.

5. The container of claim 1 wherein the weld is formed by an electron beam welding process.

6. A method of making a container complying with ANSI® N14.1 for transporting uranium hexafluoride ($UF_6$) comprising the steps of:

providing a cylindrical shell having two open ends and at least one cylinder head for closing an open end of the cylindrical shell, forming an annular land on each of the shell and the head including forming a beveled weld face radially outward of the land on each of the shell and the head positioning an inner periphery of the land on the shell and the land on the head to form a substantially smooth transition from the head to the shell in the interior of the container and positioning the beveled surfaces on the shell and the heads to define a generally V-shaped groove; and joining the shell and the heads together by a plasma arc weld which fully penetrates the opposing lands thereby leaving an inner surface in the container which provides a substantially smooth transition from the shell to the heads and by a second weld radially outward of the plasma weld and substantially filling the remainder of the V-shaped groove.

7. A container for transporting hazardous materials which minimizes entrapment of contaminants and thereby increases the decontaminability of the container comprising:

a cylindrical shell;

two cylinder heads, each head closing one end of the shell;

the shell and the heads each having an annular land; and the shell and the heads being joined together by a plasma weld penetrating the opposing lands and forming a substantially smooth transition zone between the shell and the heads and wherein the shell and the heads each have a beveled surface radially outward of the land;

the beveled surfaces on the shell and the heads cooperating to define a generally V-shaped groove;

the shell and the heads being further joined together by a second weld radially outward of the plasma weld which substantially fills the remainder of the V-shaped groove.

* * * * *